US007484394B2

(12) United States Patent
Ogishi et al.

(10) Patent No.: US 7,484,394 B2
(45) Date of Patent: Feb. 3, 2009

(54) GEAR ROLL-FORMING APPARATUS

(75) Inventors: Nobuo Ogishi, Shizuoka-ken (JP); Yasushi Ichihara, Shizuoka-ken (JP)

(73) Assignee: Toyoseiki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/561,252

(22) Filed: Nov. 17, 2006

(65) Prior Publication Data

US 2007/0068211 A1 Mar. 29, 2007

(51) Int. Cl.
*B21B 27/00* (2006.01)
*B21D 15/00* (2006.01)

(52) U.S. Cl. ..... 72/102; 72/108; 29/893.32

(58) Field of Classification Search ..... 72/69, 72/84, 86, 101, 102, 107, 108, 104; 29/893.32
See application file for complete search history.

(56) References Cited

U.S. PATENT DOCUMENTS 1,669,818 A * 5/1928 Gleason et al. ..... 72/84
3,359,769 A * 12/1967 Kotov et al. ..... 72/69
3,377,829 A * 4/1968 Ivanov et al. ..... 72/86
3,455,139 A * 7/1969 Joslin et al. ..... 72/412
3,583,190 A * 6/1971 Wildhaber ..... 72/84
3,704,612 A * 12/1972 Loos ..... 72/102
4,111,031 A 9/1978 Vennemeyer et al.
4,244,668 A 1/1981 Demuth
4,519,231 A 5/1985 Roth
4,573,399 A 3/1986 Wilson
4,739,644 A 4/1988 Maki et al.
4,777,204 A 10/1988 Ikenaga et al.
4,872,791 A 10/1989 Crankshaw
4,885,831 A 12/1989 Fett
5,337,626 A 8/1994 Everts et al.
5,709,118 A 1/1998 Ohkubo
5,746,085 A 5/1998 Harada et al.
5,829,297 A 11/1998 Ohkubo
5,930,896 A 8/1999 Akiyoshi et al.
5,996,229 A 12/1999 Yang
6,076,387 A * 6/2000 Siewert et al. ..... 72/69
6,113,848 A 9/2000 Sugimoto et al.
6,156,265 A 12/2000 Sugimoto (Continued)

FOREIGN PATENT DOCUMENTS

JP 2003-053467 2/2003

*Primary Examiner*—Edward Tolan
(74) *Attorney, Agent, or Firm*—Knobbe, Martens, Olson & Bear, LLP.

(57) ABSTRACT

A gear roll-forming apparatus includes: a pinion die that is substantially the same in configuration and size as a bevel pinion; a pinion die holder for supporting the pinion die so as to allow rotation of the pinion die about a first axis of the pinion die while preventing axial movement B of the pinion die in an axial direction thereof from a small-diameter side toward a large-diameter side thereof; a gear die that is substantially the same in configuration and size as a bevel gear and meshes with the pinion die; and a pressing member for bringing a bevel gear blank into press contact with the pinion die, the bevel gear blank being arranged so as to sandwich the pinion die in cooperation with the gear die. By relatively rotating the gear die and the pinion die holder about a second axis of the gear die, the teeth of the pinion die are rolled with respect to the bevel gear blank.

10 Claims, 11 Drawing Sheets

U.S. PATENT DOCUMENTS

| | | | |
|---|---|---|---|
| 6,247,912 | B1 | 6/2001 | Sugimoto et al. |
| 6,354,976 | B1 | 3/2002 | Mills |
| 6,484,401 | B1 | 11/2002 | Specht |
| 6,494,072 | B2 | 12/2002 | Tittmann |
| 6,951,501 | B2 | 10/2005 | Tan |
| 7,094,009 | B2 | 8/2006 | Chao et al. |
| 7,117,598 | B2 | 10/2006 | Prucher |
| 7,152,446 | B2 | 12/2006 | Wada et al. |
| 7,347,076 | B1 | 3/2008 | Cha |
| 2001/0025520 | A1 | 10/2001 | Tittmann |
| 2002/0184767 | A1 | 12/2002 | Specht |
| 2003/0207650 | A1 | 11/2003 | Tan |
| 2005/0062832 | A1 | 3/2005 | Mitamura et al. |
| 2005/0166654 | A1 | 8/2005 | Wada et al. |
| 2006/0021225 | A1 | 2/2006 | Mataga |
| 2006/0062643 | A1 | 3/2006 | Chao et al. |
| 2007/0068211 | A1 | 3/2007 | Ogishi et al. |
| 2008/0073816 | A1 | 3/2008 | Oberle et al. |
| 2008/0105021 | A1 | 5/2008 | Hodjat et al. |
| 2008/0141812 | A1 | 6/2008 | Okabe |

* cited by examiner

GEAR ROLL-FORMING APPARATUS

BACKGROUND OF THE INVENTION

1. Field of the Invention

The present invention relates to a gear roll-forming apparatus capable of roll-forming a bevel gear or a bevel pinion.

2. Description of the Related Art

A conventional gear roll-forming apparatus can enable roll-forming of a large-diameter bevel gear that can mesh with a bevel pinion. In one such arrangement, the first gear roll-forming apparatus includes a pinion die of substantially the same configuration and size as the bevel pinion, a driver that supports the pinion die so that the pinion die can be driven to rotate about its axis, and a support member for supporting an annular bevel gear blank, with which the pinion die can be brought into press contact, so that the bevel gear blank can rotate about its axis.

The pinion die is brought into press contact with the bevel gear blank, and the pinion die is rotated. Then, the bevel gear blank rotates in synchronism with this rotation, causing the teeth of the pinion die to roll with respect to the bevel gear blank. Accordingly, teeth corresponding to the profile of the teeth of the pinion die are roll-formed in the bevel gear blank, that is, the bevel gear is roll-formed.

On the other hand, Japanese Patent Document JP-A-2003-53467 discloses another type of conventional gear roll-forming apparatus that enables roll-forming of the bevel pinion of a small diameter. According to the structure disclosed in this publication, the second gear roll-forming apparatus includes a pair of rack-type flat dies arranged in such a manner that their respective teeth are opposed to each other. The tooth profile of each of these flat dies is made to approximate the tooth profile of the bevel pinion.

While sandwiching the bevel pinion blank between the two flat dies, the two flat dies are moved in opposite directions with respect to the longitudinal direction of the flat dies. This causes the respective teeth of these flat dies to roll relative to the bevel pinion blank, whereby teeth corresponding to the profile of the teeth of the respective flat dies are roll-formed in the bevel pinion blank, that is, the bevel pinion is roll-formed.

SUMMARY OF THE INVENTION

In the first gear roll-forming apparatus described above, when the pinion die is brought into press contact with the bevel gear blank, there are cases where a large bending moment is applied to the axial ends of the pinion die due to the reaction force from the bevel gear blank side. In this case, it is not easy to make the pinion die retain a rigidity sufficient to resist the reaction force from the bevel gear blank. As a result, when roll-forming a bevel gear using such a pinion die, it is not easy to achieve a satisfactory improvement in the dimensional accuracy of this bevel gear.

On the other hand, in the second gear roll-forming apparatus described above, the flat dies used are of a rack type, and their tooth profiles are only made to approximate the tooth profile of the bevel pinion. Accordingly, in the case of a bevel pinion roll-formed by such rack-type flat dies as well, it is not easy to achieve a satisfactory improvement in the dimensional accuracy of the bevel pinion.

Accordingly, an object of the present invention is to achieve a satisfactory improvement in the dimensional accuracy of a bevel gear or bevel pinion that is roll-formed.

Accordingly, one aspect of the present invention is a gear roll-forming apparatus for roll-forming of a bevel gear capable of meshing with a bevel pinion. The apparatus includes a pinion die that is substantially the same in configuration and size as the bevel pinion. A pinion die holder is configured to support the pinion die so and to allow rotation of the pinion die about a first axis of the pinion die while substantially preventing movement of the pinion die in an axial direction of the pinion die from a small-diameter side toward a large-diameter side thereof. A gear die is substantially the same in configuration and size as the bevel gear and meshes with the pinion die. A press member brings a bevel gear blank into press contact with the pinion die. The bevel gear blank is configured to sandwich the pinion die in cooperation with the gear die. The gear die and the pinion die holder can be relatively rotated about a second axis of the gear die, causing teeth of the pinion die to roll with respect to the bevel gear blank.

Another aspect of the present invention is a gear roll-forming apparatus which enables roll-forming of a bevel pinion capable of meshing with a bevel gear. The apparatus includes a pair of gear dies that are substantially the same in configuration and size as the bevel gear and arranged so that their respective teeth are opposed to each other. A pinion blank holder is configured to support a bevel pinion blank so as to allow rotation of the bevel pinion blank about a first axis of the bevel pinion blank while preventing movement of the bevel pinion blank in an axial direction of the bevel pinion blank from a small-diameter side toward a large-diameter side thereof. A press member brings each of the gear dies into press contact with the bevel pinion blank that is sandwiched between the gear dies. At least one of the gear dies and the pinion blank holder are relatively rotated about a second axis of the gear die, causing teeth of the gear die to roll with respect to the bevel pinion blank.

DETAILED DESCRIPTION OF THE PREFERRED EMBODIMENTS

As will be described below, a gear roll-forming apparatus is capable of roll-forming a bevel gear that can mesh with a bevel pinion. In one embodiment described below, the gear roll-forming apparatus includes: a pinion die that is substantially the same in configuration and size as the bevel pinion; a pinion die holder for supporting the pinion die so as to allow rotation of the pinion die about a first axis of the pinion die while preventing movement of the pinion die in an axial direction of the pinion die from a small-diameter side toward a large-diameter side thereof, a gear die that is substantially the same in configuration and size as the bevel gear and meshes with the pinion die; and a pressing member for bringing a bevel gear blank into press contact with the pinion die, the bevel gear blank being arranged so as to sandwich the pinion die in cooperation with the gear die.

In this embodiment, by relatively rotating the gear die and the pinion die holder about the second axis of the gear die, the respective teeth of the pinion die are rolled with respect to the bevel gear blank. Then, due to this rolling motion, teeth corresponding to the profile of the teeth of the pinion die are roll-formed in the bevel gear blank.

Figure 1:
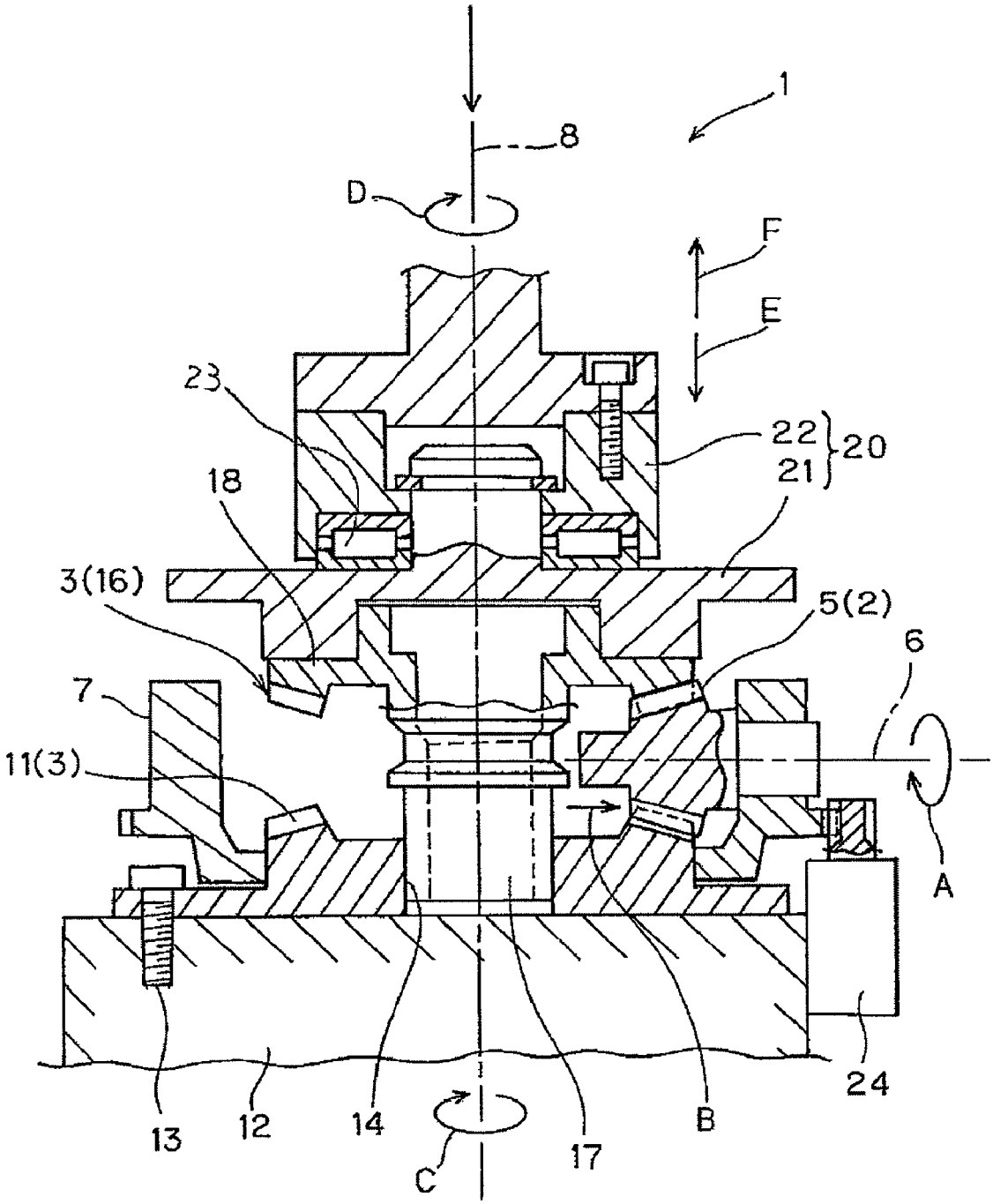
FIG. 1 is a side sectional view of a first embodiment of a gear roll-forming apparatus after roll-forming of a bevel gear.
Figure 2:
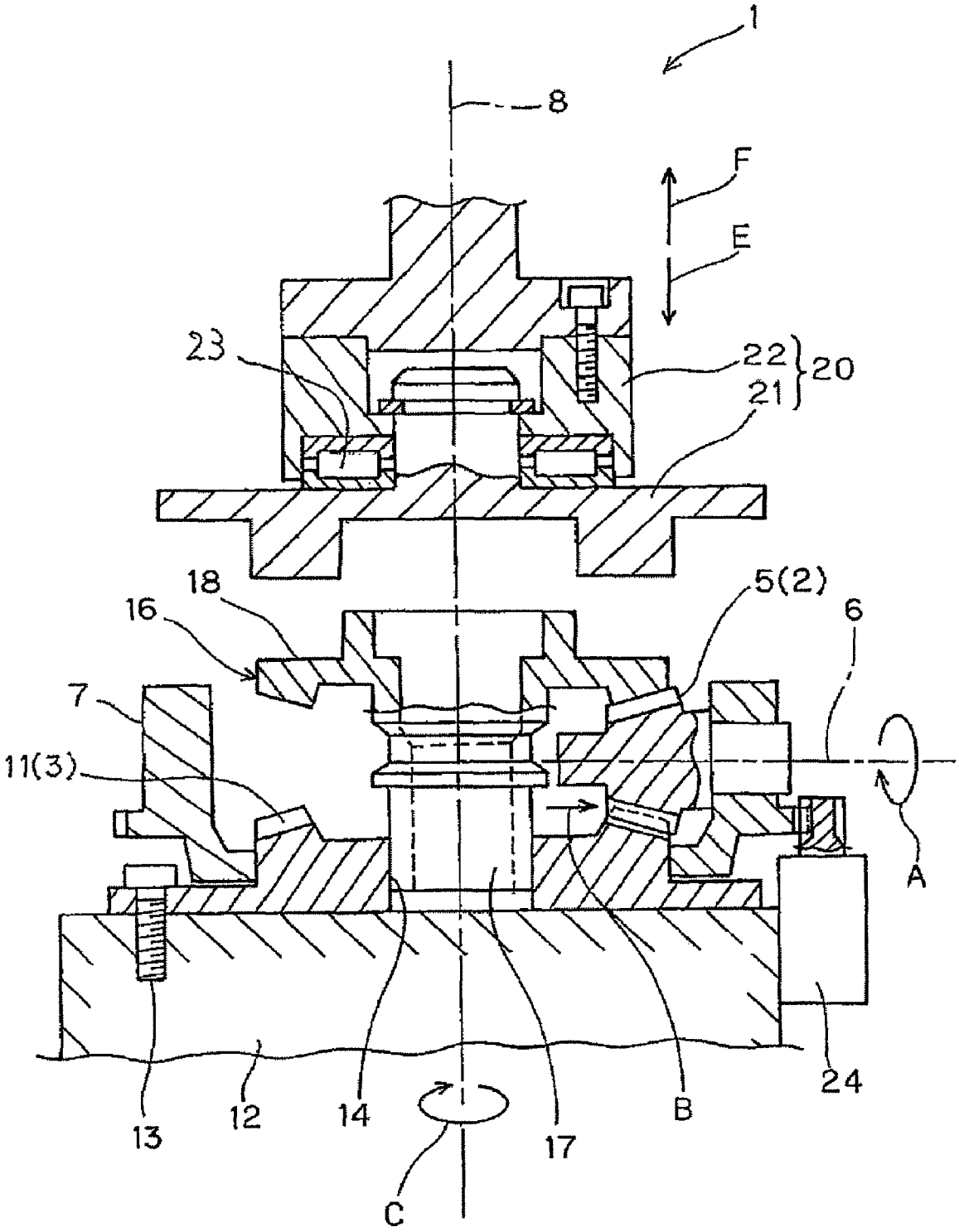
FIG. 2 is a side sectional view of the gear roll-forming apparatus of FIG. 1 prior to the roll-forming of the bevel gear.
Figure 3:
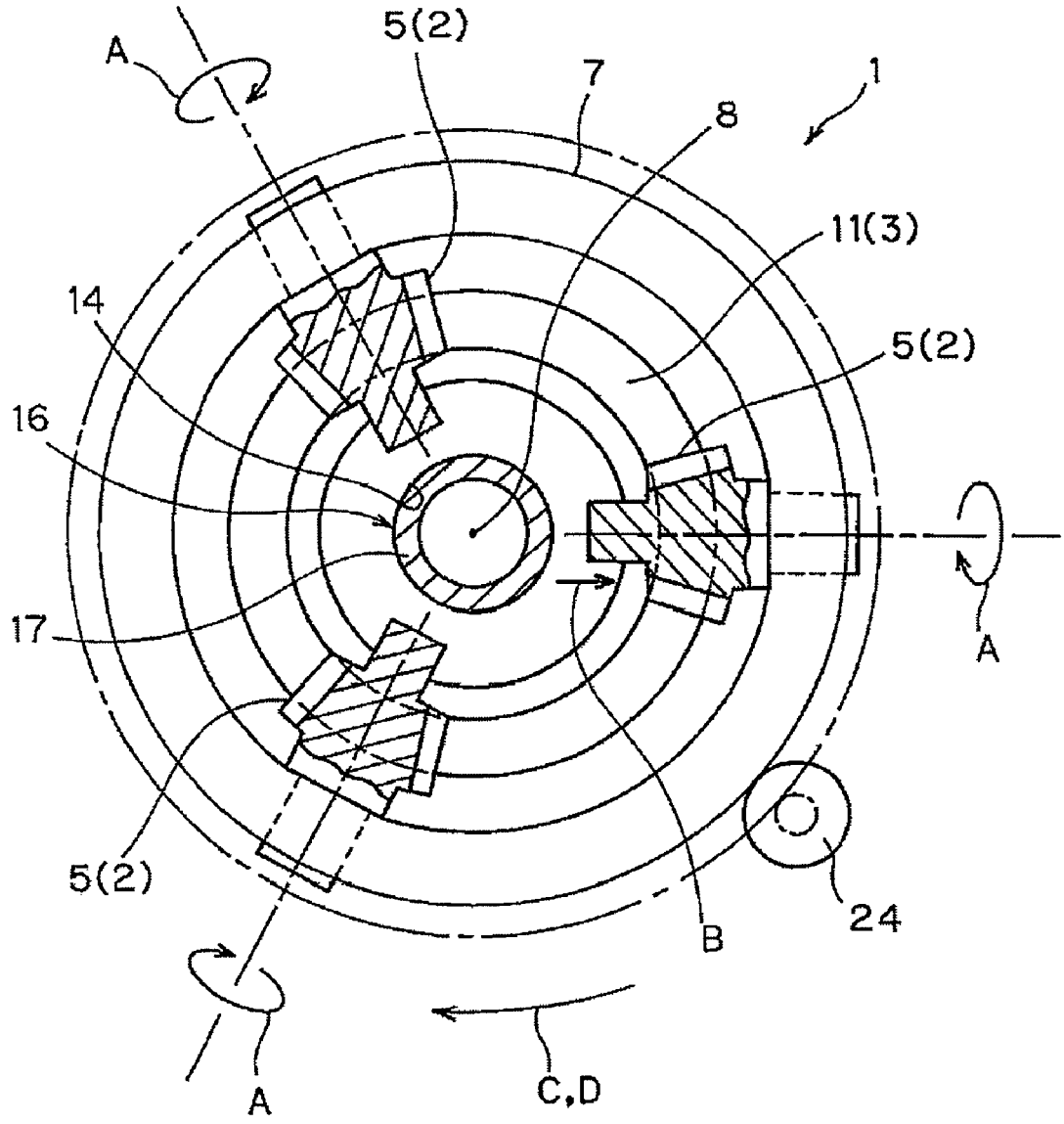
FIG. 3 is a plan section view of the gear roll-forming apparatus of FIG. 1.

With reference now to FIGS. 1 to 3, an example embodiment will be described in more detail.

In FIGS. 2 and 3, reference numeral 1 denotes a gear roll-forming apparatus. The gear roll-forming apparatus 1 is capable of roll-forming a bevel gear 3 that is a large-diameter ring gear capable of meshing with a bevel pinion 2.

The gear roll-forming apparatus 1 can include a pinion die 5 of substantially the same configuration and size as the bevel pinion 2, and a pinion die holder 7 supporting the pinion die 5 in a cantilevered fashion so as to allow rotation A of the pinion die 5 about a horizontal first axis 6 thereof. The pinion die holder 7 can have a ring-shaped configuration, and its second axis 8 can extend vertically. A plurality of (three) pinion dies 3 can be provided at substantially equal intervals in the circumferential direction of the pinion die holder 7. The pinion dies 5 can be supported on the pinion die holder 7 so as to prevent movement B of the pinion dies 5 in the respective axial directions of the pinion dies 5 from the small-diameter side to the large-diameter side thereof (i.e. outwards with respect to the radial direction of the pinion die holder 7).

A gear die 11 of substantially the same configuration and size as the bevel gear 3 can be provided. The gear die 11 can be located on the second axis 8 of the pinion die holder 7 and fixed onto a base 12 with a fastening member 13. The pinion die holder 7 can be supported on the gear die 11 in such a manner as to allow its rotation C about the second axis 8. The first and second axes 6, 8 can be orthogonal or substantially orthogonal to each other, and the pinion die 5 and the gear die 11 can be in meshing engagement with each other. A mating hole 14 cam be formed in the gear die 11 at a position on the second axis 8.

A bevel gear blank 16 for forming the bevel gear 3 can be arranged on the second axis 8. The bevel gear blank 16 can include a cylindrical boss portion 17 that is located on the second axis 8 and whose lower end portion (one end portion) can be fitted into the mating hole 14 so as to allow its rotation D about the second axis 8, and a blank body 18 formed integrally at an axially midway portion of the boss portion 17 on the second axis 8. The gear die 11 and the blank body 18 of the bevel gear blank 16 can sandwich the pinion die 5 therebetween in the axial direction of the second axis 8.

A pressing member 20 for bringing the blank body 18 of the bevel gear blank 16 into press contact with the pinion die 5 can be provided. The pressing member 20 can include a pressing base 21 located on the second axis 8 and detachably mated with the upper end portion (other end portion) of the boss portion 17 of the bevel gear blank 16, and a pressing drive portion 22 for pressing the pressing base 21 against the bevel gear blank 16 while permitting the rotation D of the pressing base 21 about the second axis 8 together with the bevel gear blank 16 by, for example, a bearing 23. The pressing member 20 can be capable of approaching movement E (see arrow in FIG. 1) or separating movement F with respect to the bevel gear blank 16 in the axial direction of the second axis 8. It should be noted that the pressing member 20 can include a hydraulic system (not shown) as a drive source for effecting the approaching movement E or separating movement F of the pressing base 21 with respect to the bevel gear blank 16.

An electric motor 24 for effecting the rotation C of the pinion die holder 7 about the second axis 8 can be provided. The electric motor 24 can be driven forward or reverse, thus allowing the rotation C and rotation reverse to the rotation C of the pinion die holder 7. That is, during the relative rotations of the pinion die holder 7 and gear die 11 about the second axis 8, the gear die 11 is made stationary while the pinion die holder 7 is allowed to rotate forward or reverse.

An embodiment of a rolling-forming method for the bevel gear 3 using the gear roll-forming apparatus 1 will now be described.

Referring to FIGS. 2 and 3, first, the lower end portion of the boss portion 17 of the bevel gear blank 16 can be fitted into the mating hole 14, thereby placing the bevel gear blank 16 on the second axis 8. Next, the pressing member 20 can be caused to make the approaching movement E toward the bevel gear blank 16 so as to press the bevel gear blank 16. The gear die 11 and the bevel gear blank 16 can thus be brought into press contact with the pinion die 5. On the other hand, by driving the electric motor 24, the pinion die holder 7 is driven to undergo the rotation C. That is, the gear die 11 and the pinion die holder 7 are relatively rotated about the second axis 8.

Then, due to the meshing engagement between the pinion die 5, which undergoes the rotation C about the second axis 8 together with the pinion die holder 7, and the gear die 11, the pinion die 5 undergoes the rotation A about the first axis 6 thereof. Then, the blank body 18 of the bevel gear blank 16, which is held in press contact with the pinion die 5, is caused to undergo the rotation D about the second axis 8 at a speed twice that of the rotation C due to the friction force applied from the pinion die 5. This causes the teeth of the pinion die 5 to roll with respect to the bevel gear blank 16; as this rolling motion is repeated, eventually, as shown in FIG. 1, teeth corresponding to the profile of the teeth of the pinion die 5 are roll-formed in the bevel gear blank 16. That is, a desired bevel gear 3 is roll-formed.

In this regard, the pinion die 5 is supported on the pinion die holder 7. When, during the roll-forming of the bevel gear 3, the pinion die 5 is brought into press contact with the bevel gear blank 16 by the pressing member 20, a press-contact force as the reaction force from the bevel gear blank 16 is applied to the pinion die 5. At this time, the bevel gear blank 16 sandwiches the pinion die 5 in cooperation with the gear die 11. Accordingly, at least part of the press-contact force applied to the pinion die 5 from the bevel gear blank 16 is borne by the gear die 11. A large bending moment due to the above-mentioned press contact is thus prevented from acting on the pinion die 5. That is, occurrence of bending stress in the pinion die 5 is suppressed.

The pinion die 5 is thus allowed to retain sufficient rigidity, whereby teeth corresponding to the profile of the teeth of the pinion die 5 are roll-formed in the bevel gear blank 16 with greater accuracy. That is, the dimensional accuracy of the bevel gear 3 thus roll-formed is improved in a more satisfactory manner. In this case, the pinion die 5 is supported in a cantilevered fashion. The rigidity of the pinion die 5 thus tends to become insufficient. According to the above-described construction, however, the rigidity of the pinion die 5 is more reliably retained by the gear die 11 and the bevel gear blank 16, thereby achieving a further improvement in the dimensional accuracy of the bevel gear 3.

Here, when the pinion die 5, and the gear die 11 and the bevel gear blank 16 are brought into press contact with each other by the pressing member 20 as described above, the axial component force applied to the pinion die 5 causes the pinion die 5 to make involuntary movement B from the small-diameter side toward the large-diameter side thereof.

However, as described above, the pinion die holder 7 prevents or substantially prevents such movement B of the pinion die 5 from the small-diameter side toward the large-diameter side in the axial direction thereof.

Accordingly, teeth corresponding to the profile of the teeth of the pinion die 5 are roll-formed in the bevel gear blank 16 with greater accuracy. That is, a further improvement is achieved in terms of the dimensional accuracy of the bevel gear 3 thus roll-formed.

Further, as described above, the press-contact forces applied from the gear die 11 and the bevel gear blank 16 to the pinion die 5 can be opposed to each other, thus preventing bending stress from being exerted on the pinion die 5. Accordingly, the requisite rigidity or strength of the pinion die 5 and the pinion die holder 7 supporting the pinion die 5 can be set low. This allows a corresponding reduction in the size and cost of the gear roll-forming apparatus 1.

Further, as described above, the plurality of pinion dies 5 are provided and arranged at substantially equal intervals in the circumferential direction of the second axis 8 of the gear die 11.

Accordingly, when, as described above, the bevel gear blank 16 is brought into press contact with each of the pinion dies 5 by the pressing member 20, the reaction forces applied from the respective pinion dies 5 to the bevel gear blank 16 in opposition to the press contact force become uniform. The roll-forming of the bevel gear blank 16 by the respective pinion dies 5 thus can proceed in a uniform manner, and the bevel gear blank 16 is accurately moved in parallel toward each of the pinion dies 5 in the axial direction of the second axis 8.

Therefore, the teeth corresponding to the profile of the teeth of each pinion die 5 are roll-formed in the bevel gear blank 16 with greater accuracy. That is, a further improvement is achieved in terms of the dimensional accuracy of the bevel gear 3 thus roll-formed.

Further, as described above, during the relative rotation between the pinion die holder 7 and the gear die 11, the gear die 11 can be made stationary while the pinion die holder 7 is allowed to rotate forward or reverse.

Accordingly, as described above, when roll-forming the bevel gear 3 by the pinion die 5, at the time of the relative rotation between the pinion die holder 7 and the gear die 11, the pinion die holder 7 is caused to undergo the rotation C in one direction and then rotated in the direction reverse to that direction, and such forward/reverse rotation can be repeatedly performed. This makes it possible to eliminate an unbalance in the gear roll-forming apparatus 1 occurring when rotation takes place in only one direction. Therefore, the sectional configuration of the tooth profile of the bevel gear 3 thus roll-formed can be made laterally uniform with greater accuracy. That is, a further improvement is achieved in terms of the dimensional accuracy of the bevel gear 3 thus roll-formed.

It should be noted that while the foregoing is directed to the example illustrated in the drawings, the number of the pinion dies 5 may be one or two or more. Further, the pinion die 5 may be double-cantilevered on the pinion die holder 7.

Further, when the module of the bevel gear 3 to be roll-formed is large, the roll-forming may be performed in a plurality of steps including rough roll-forming and finish roll-forming by selecting the press contact force between the pinion die 5 and the bevel gear blank 16 and the speed of the rotation C of the pinion die holder 7 as appropriate. This allows an overall reduction in the time required for roll-forming the bevel gear 3, whereby a bevel gear 3 of high accuracy can be obtained at low cost.

FIGS. 4 to 11 below show Embodiments 2 to 7 of a gear roll-forming apparatus. The constructions and effects of these embodiments are in many aspects common to those of the embodiment of FIGS. 1-3. Accordingly, such common features are denoted by common reference numerals in the drawings and detailed description thereof will be omitted. The following description will mainly focus on differences. Further, the constructions of the respective portions of these embodiments may be combined with each other in the light of the objects and effects of the present invention.

Figure 4:
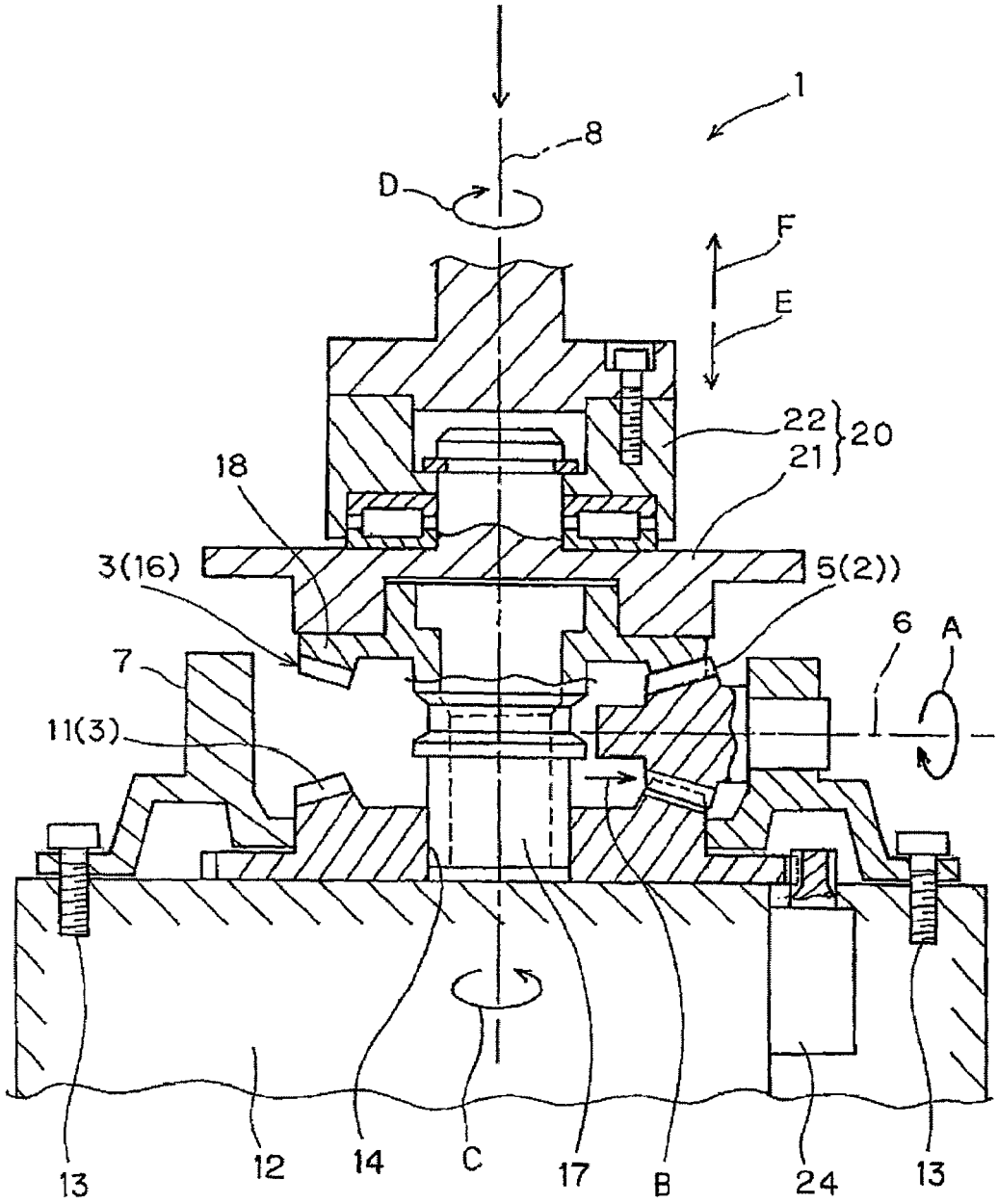
FIG. 4 is a side sectional view of a second embodiment of a gear roll-forming apparatus after roll-forming of a bevel gear.

Embodiment 2 will now be describe with reference to FIG. 4.

In this embodiment, instead of causing the pinion die holder 7 to undergo the rotation C by the electric motor 24 in Embodiment 1, the gear die 11 is caused to undergo the rotation C. Further, the pinion die holder 7 can be retained on the base 12 with the fastening member 13 so as to prevent the pinion die holder 7 from rotating about the second axis 8 while permitting slight parallel movement of the same in the axial direction of the second axis 8. Further, when the electric motor 24 is driven to cause the gear die 11 to undergo the rotation C, the gear die 11 and the pinion die holder 7 rotate relative to each other about the second axis 8.

Figure 5:
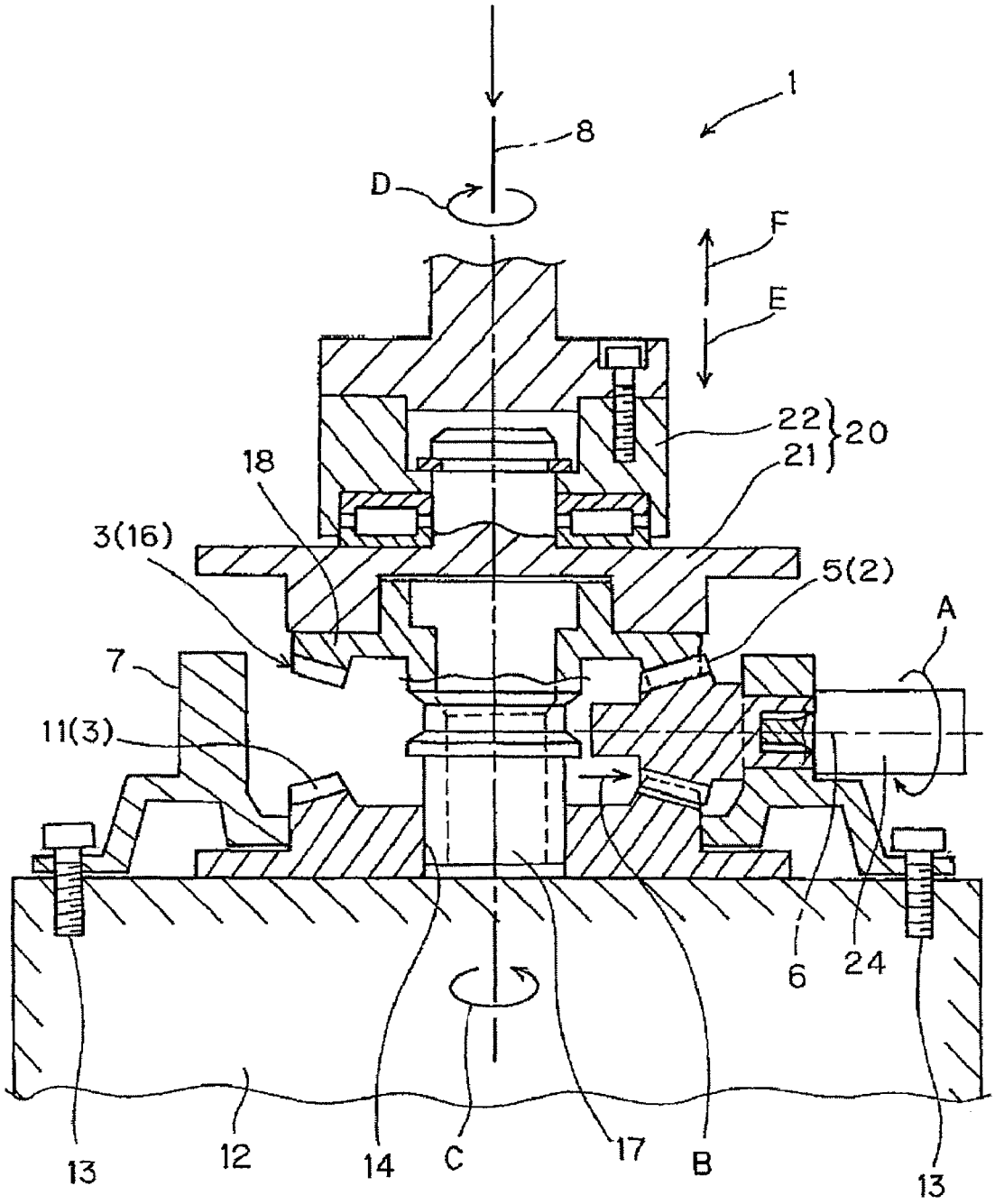
FIG. 5 is a side sectional view of third embodiment of a gear roll-forming apparatus after roll-forming of a bevel gear.

Embodiment 3 will now be describe with reference to FIG. 5.

In this embodiment, instead of causing the gear die 11 to undergo the rotation C by the electric motor 24 in Embodiment 2, the pinion die 5 is driven to undergo the rotation A. In this case, the electric motor 24 is located on the first axis 6 of the pinion die 5 and is supported on the pinion die holder 7 to be directly coupled to the pinion die 5. When the pinion die 5 is driven to undergo the rotation A by driving the electric motor 24, the gear die 11 and the pinion die holder 7 rotate relative to each other about the second axis 8.

Figure 6:
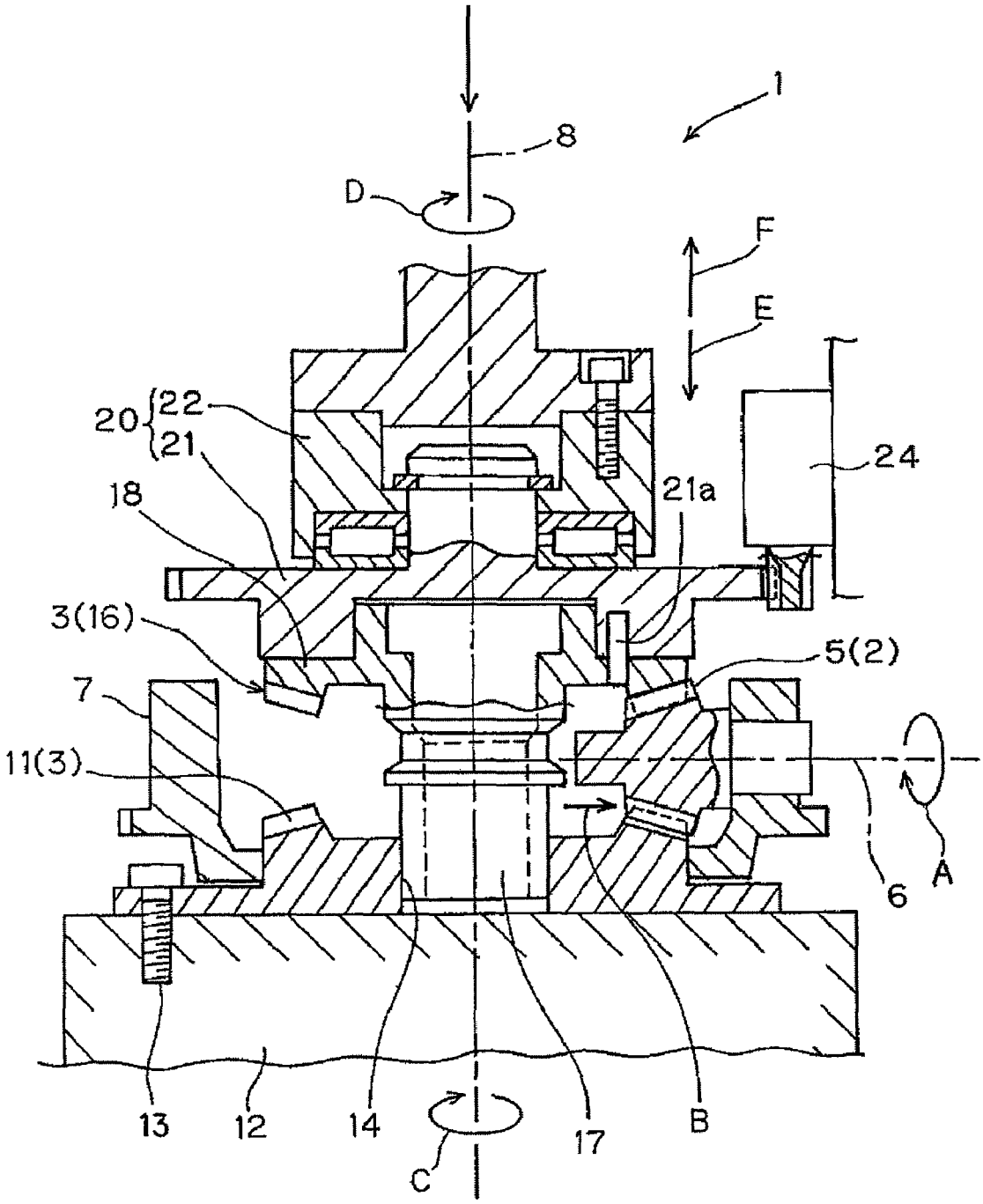
FIG. 6 is a side sectional view of a fourth embodiment of a gear roll-forming apparatus after roll-forming of a bevel gear.

Embodiment 4 will now be described with reference to the FIG. 6.

In this embodiment, instead of causing the pinion die holder 7 to undergo the rotation C by the electric motor 24 in Embodiment 1, the pressing base 21 of the pressing member 20 is caused to undergo the rotation D. In this case, the pressing base 21 is provided with a protruding engaging portion 21*a* that detachably engages with the bevel gear blank 16 so that the bevel gear blank 16 rotates together with the pressing base 21. When the electric motor 24 is driven to cause the pressing base 21 of the pressing member 20 to undergo the rotation D, the gear die 11 and the pinion die holder 7 rotate relative to each other about the second axis 8.

Embodiment 5 will now be described with reference to the FIGS. 7 and 8.

Figure 7:
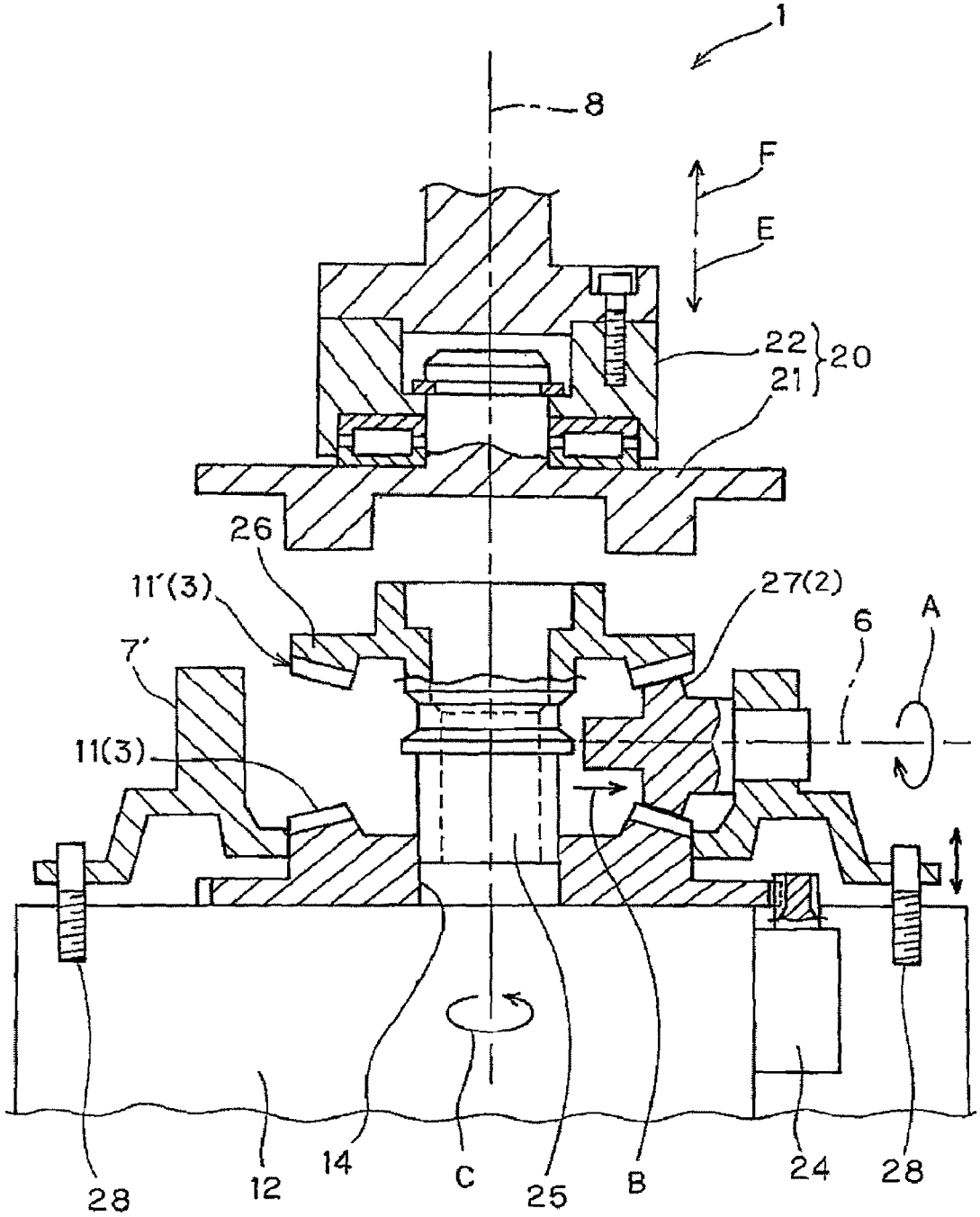
FIG. 7 is a side sectional view of a fifth embodiment of a gear roll-forming apparatus illustrating roll-forming of a bevel pinion.
Figure 8:
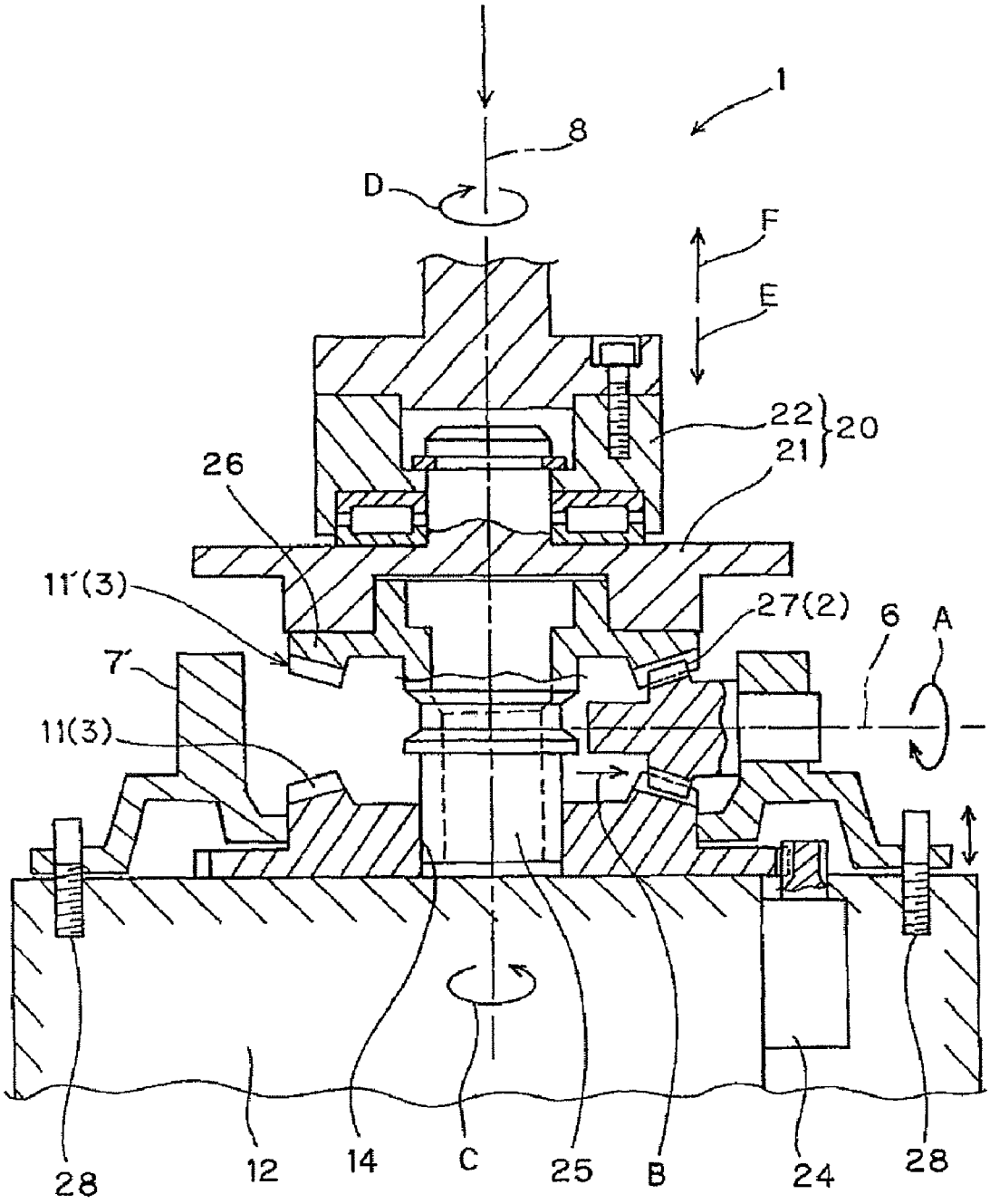
FIG. 8 is a side sectional view of the embodiment of FIG. 7 illustrating roll-forming of a bevel pinion.

Referring to FIG. 7, the gear roll-forming apparatus 1 enables roll-forming of the bevel pinion 2 that is capable of meshing engagement with the bevel gear 3.

The gear roll-forming apparatus 1 includes a pair of gear dies 11, 11' having substantially the same configuration and size as the bevel gear 3 and arranged so that the teeth of the respective gear dies are opposed to each other. Both the gear dies 11, 11' are arranged on the second axis 8. Of the two gear dies 11, 11', the lower gear die 11 can be driven by the electric motor 24 to undergo the rotation C about the second axis 8. On the other hand, the upper gear die 11' includes a cylindrical boss portion 25 that is located on the second axis 8 and whose lower end portion (one end portion) is fitted into the mating hole 14 so as to allow its rotation D about the second axis 8, and a gear die body 26 formed integrally at an axially midway portion of the boss portion 25 on the second axis 8.

Further, the gear roll-forming apparatus 1 includes pinion blank holders 7' each supporting a bevel pinion blank 27 for forming the bevel pinion 2 in a cantilevered manner so as to allow the rotation A thereof about the first axis 6. The pinion blank holders 7' are guided by guides 28 protruding from the base 12 so as to be capable of parallel movement only in the axial direction of the second axis 8.

A plurality of (e.g., three) bevel pinion blanks 27 can be provided at substantially equal intervals in the circumferential direction of the pinion blank holders 7'. The bevel pinion blanks 27 can be supported on the pinion blank holders 7' so as to prevent movement B of the bevel pinion blanks 27 in the respective axial directions of the bevel pinion blanks 27 from the small-diameter side toward the large-diameter side thereof (i.e. outwards with respect to the radial direction of the pinion blank holders' 7). Upon the completion of roll-forming, the bevel pinion blanks 27 are detached from the holders 7', and new, unprocessed bevel pinion blanks 27 are mounted.

Each of the bevel pinion blanks 27 can be sandwiched between the two gear dies 11, 11' in the axial direction of the second axis 8. The pressing member 20 for bringing the gear dies 11, 11' into press contact with the respective bevel pinion blanks 27 can be provided.

An embodiment of a method of roll-forming the bevel pinion 2 using the gear roll-forming apparatus 1 will now be described.

Referring to FIG. 7, first, the lower end portion of the boss portion 25 of the upper gear die 11' can be fitted into the mating hole 14, thereby placing the gear die 11' on the second axis 8. Next, the pressing member 20 is caused to make approaching movement E toward the gear die 11' so as to press the gear die 11'. Both the gear dies 11, 11' are thus brought into press contact with bevel pinion blanks 27. On the other hand, when the electric motor 24 is driven so that the lower gear die 11 is driven to undergo the rotation C, the gear die 11 and each pinion blank holder 7' are relatively rotated about the second axis 8.

Then, the bevel pinion blanks 27, which are held in press contact with the gear die 11, are caused to undergo the rotation A about the first axis 6 due to the friction force applied from the gear die 11. Then, the friction force applied from the bevel pinion blanks 27 causes the upper gear die 11', which is held in press contact with the bevel pinion blanks 27, to undergo the rotation D about the second axis 8. This causes the teeth of the gear dies 11, 11' to roll with respect to the bevel pinion blanks 27 and, eventually, as shown in FIG. 8, teeth corresponding to the profile of the teeth of the gear dies 11, 11' are roll-formed in the bevel pinion blanks 27. That is, a desired bevel pinion 2 is roll-formed.

Here, the bevel pinion blanks 27 are supported on the pinion blank holders 7'. When, during the roll-forming of the bevel pinion 2, the gear dies 11, 11' are brought into press contact with the bevel pinion blanks 27 by the pressing member 20, press-contact forces from the gear dies 11, 11' are applied to the bevel pinion blanks 27. In this regard, the bevel pinion blanks 27 are sandwiched between the two gear dies 11, 11'. Furthermore, the pinion blank holders 7' supporting the gear dies 11, 11' can be freely reciprocated in the axial direction of the second axis 8. Accordingly, the press-contact forces applied from the respective gear dies 11, 11' to the bevel pinion blanks 27 become substantially uniform, thereby preventing a large bending moment from being exerted on the bevel pinion blanks 27. That is, the occurrence of bending stress in the bevel pinion blanks 27 is suppressed with greater reliability.

The bevel pinion blanks 27 are thus allowed to retain sufficient rigidity, whereby the teeth corresponding to the profile of the teeth of the respective gear dies 11, 11' are roll-formed in the bevel pinion blanks 27 with greater accuracy. That is, the dimensional accuracy of the bevel pinion 2 thus roll-formed is improved in a more satisfactory manner. In this case, the bevel pinion blanks 27 are supported in a cantilevered fashion. The rigidity of the bevel pinion blanks 27 thus tends to become insufficient. According to the above-described construction, however, the rigidity of the bevel pinion blanks 27 is more reliably retained by the gear dies 11, 11', whereby the dimensional accuracy of the bevel pinion 2 can be improved with greater reliability.

Here, when the gear dies 11, 11' and the bevel pinion blanks 27 are brought into press contact with each other by the pressing member 20 as described above, the axial component force applied to each of the bevel pinion blanks 27 causes the bevel pinion blank 27 to make involuntary movement B from the small-diameter side toward the large-diameter side thereof.

However, as described above, the pinion blank holders 7' prevent such movement B of the bevel pinion blanks 27 from the small-diameter side toward the large-diameter side in the axial direction thereof.

Accordingly, the teeth corresponding to the profile of the teeth of the respective gear dies 11, 11' are roll-formed in the bevel pinion blanks 27 with greater accuracy. That is, a further improvement is achieved in terms of the dimensional accuracy of the bevel pinion 2 thus roll-formed.

Further, the gear dies 11, 11' used are not rack-type flat dies used in the conventional art but those corresponding to the tooth profile of the bevel gear 3 that can mesh with the bevel pinion 2. Accordingly, the dimensional accuracy of the bevel pinion 2 roll-formed by the respective gear dies 11, 11' can be improved with greater reliability.

Further, as described above, the plurality of bevel pinion blanks 27 are provided and arranged at substantially equal intervals in the circumferential direction of the second axis 8 of the gear die 11.

Accordingly, when, as described above, the respective gear dies 11, 11' are brought into press contact with the bevel pinion blanks 27 by the pressing member 20, the resulting press contact forces are uniformly applied to the respective bevel pinion blanks 27. The roll-forming of the respective bevel pinion blanks 27 by the gear dies 11, 11' thus proceeds in a uniform manner, and the gear dies 11, 11' are accurately moved in parallel toward the bevel pinion blank 27 in the axial direction of the second axis 8.

Therefore, the teeth corresponding to the profile of the teeth of the respective gear dies 11, 11' are roll-formed in the bevel pinion blanks 27 with greater accuracy. That is, a further improvement is achieved in terms of the dimensional accuracy of the bevel pinion 2 thus roll-formed.

Further, according to the above-described construction, a plurality of the bevel pinions 2 can be roll-formed at the same time, thereby facilitating mass production of the bevel pinions 2.

It should be noted that while the foregoing description is directed to the examples illustrated in the drawings, the number of the bevel pinion blanks 27 may be one or two or more than three. Further, each of the bevel pinion blanks 27 may be double-cantilevered on the pinion blank holder 7'.

Embodiment 6 will now be described with reference to FIGS. 9 and 10.

In this embodiment, the pinion die 5 is adapted to make reciprocating movement in the axial direction thereof (direction reverse to B, B). Specifically, a ring-shaped cam engaging member 32, which is fitted on the pinion die holder 7 and adapted to be capable of reciprocating rotation about the second axis 8, is provided. The front end in the direction of the movement B of the pinion die 5 is brought into cam-engagement with the cam engaging member 32 through the intermediation of a ball 33. Another electric motor 34 for enabling the reciprocating rotation of the cam engaging member 32 is provided.

Figure 9:
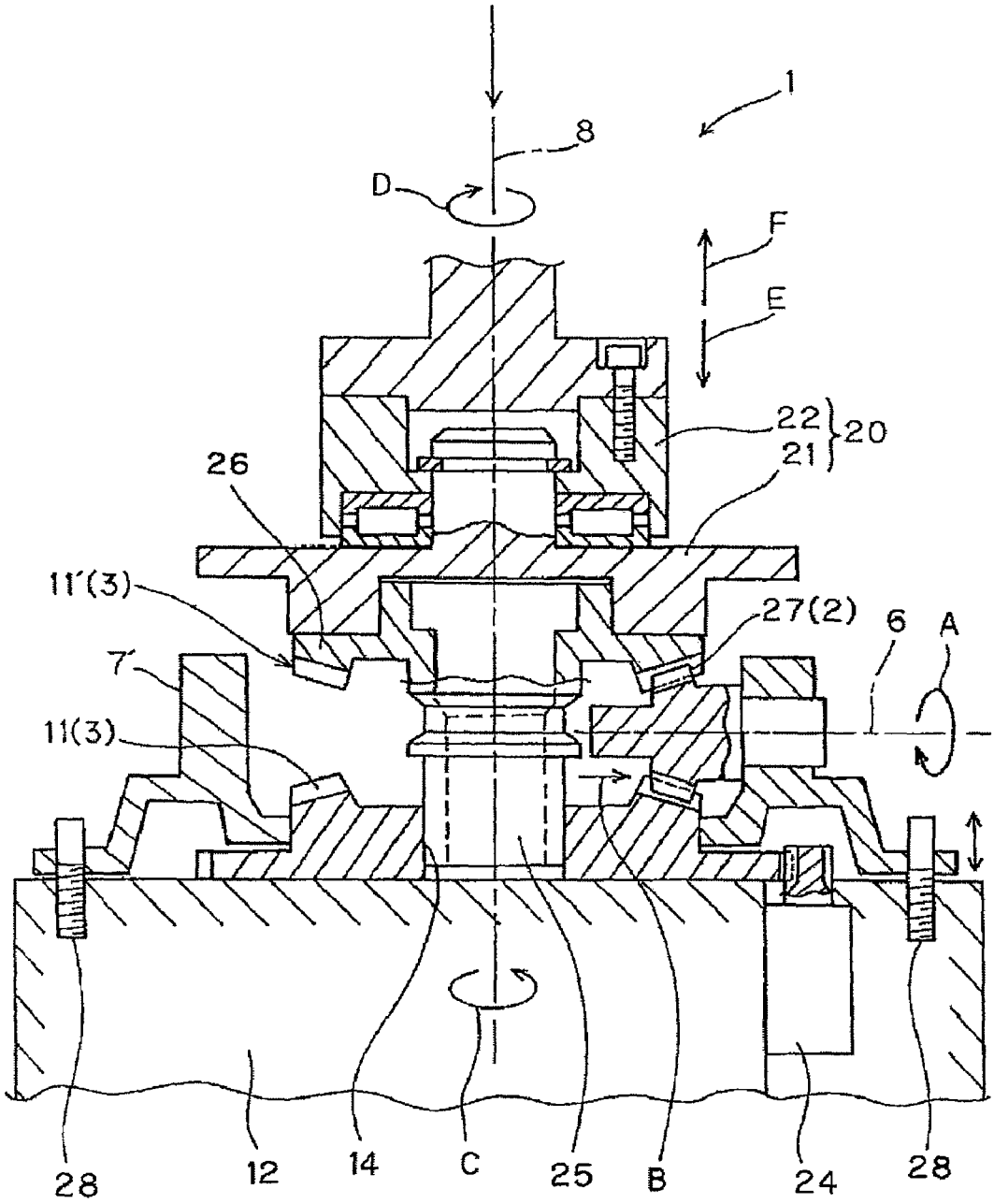
FIG. 9 is a side sectional view of a sixth embodiment of a gear roll-forming apparatus.
Figure 10:
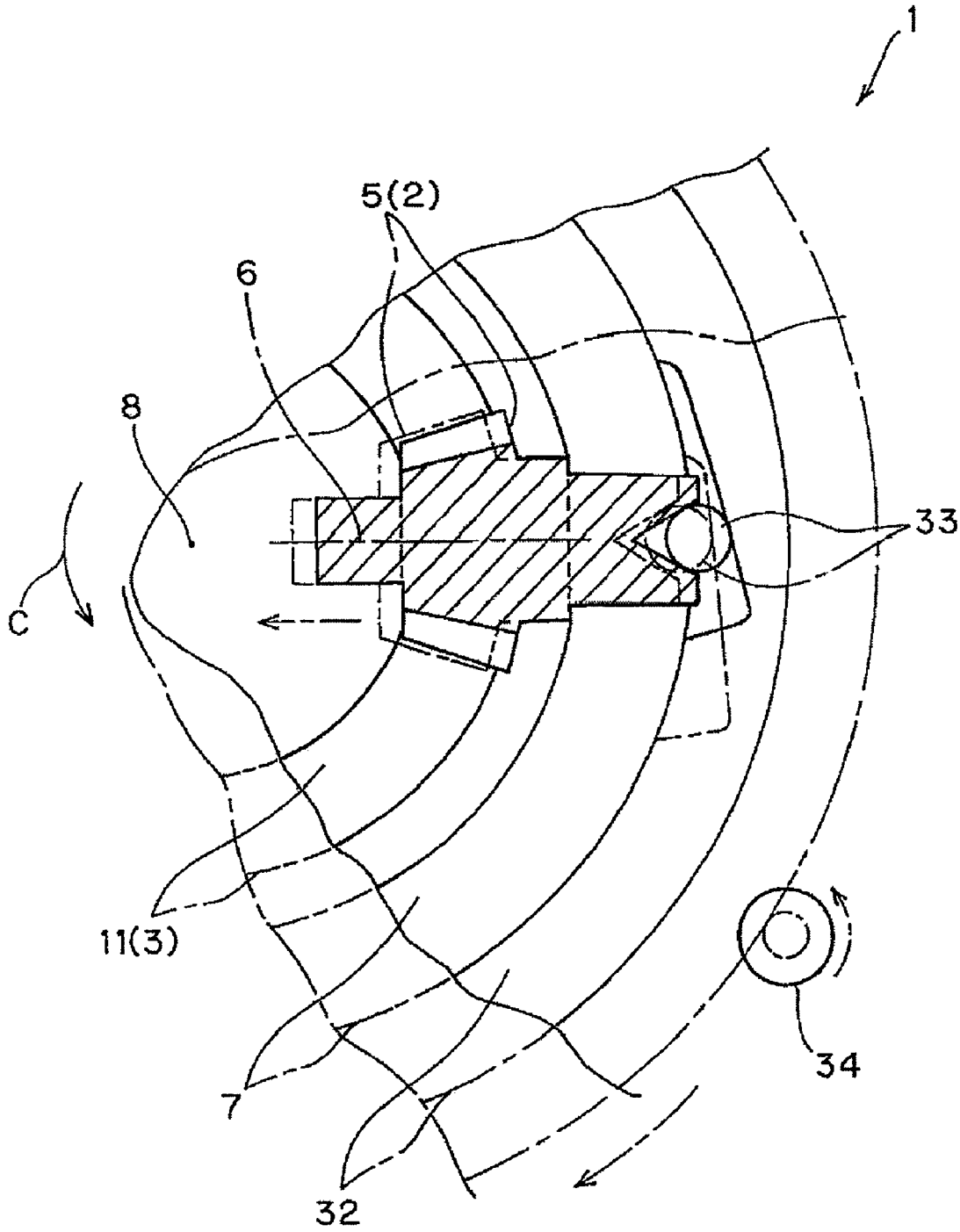
FIG. 10 is a plan section view of the embodiment of FIG. 9.

When the cam engaging member 34 is caused to undergo advance rotation by the forward drive of the electric motor 34, the pinion die 5 in cam-engagement with the cam engaging member 32 is caused to undergo forward advance movement in the movement B direction (solid lines in FIGS. 9 and 10). When the cam engaging member 32 is caused to undergo return rotation by the reverse drive of the electric motor 34, the pinion die 5 in cam-engagement with the cam engaging member 32 is caused to undergo return movement in the direction reverse to the direction of the movement B (one-dot chain lines in FIGS. 9 and 10).

According to the above-described construction, the pinion die 5 is adapted to make reciprocating movement in the axial direction thereof (direction reverse to B, B).

Accordingly, when, during the roll-forming of the bevel gear 3, the pinion die 5 is reciprocated (in the direction reverse to B, B) as described above and this reciprocating movement is repeated, crowning can be applied on the tooth profile of the roll-formed bevel gear 3. Therefore, roll-forming of the bevel gear 3 can be readily performed that is favorable in terms of noise prevention at the time of meshing engagement or durability.

Figure 11:
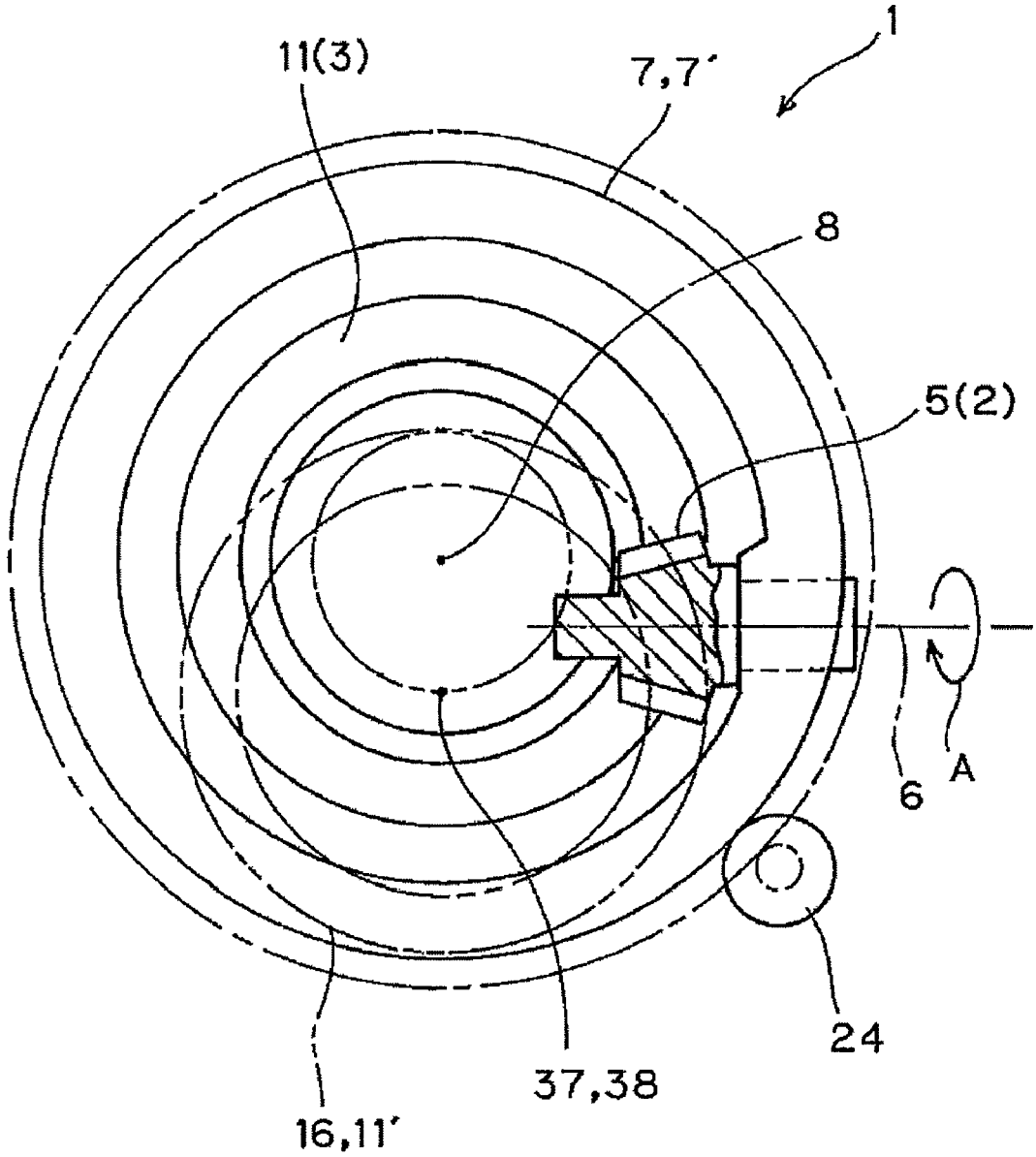
FIG. 11 is plan section view of a seventh embodiment of a gear roll-forming apparatus.

Embodiment 7 will now be described with reference to FIG. 11.

Embodiment 7 provides the gear roll-forming apparatus 1 capable of roll-forming the bevel gear 3 or the bevel pinion 2 in the case where a hypoid gear set is incorporated into the concept of a bevel gear set.

When roll-forming the bevel gear 3, a third axis 37 of the bevel gear blank 16 deviates from the second axis 8. As the roll-forming proceeds, the third axis 37 rotates in the circumferential direction of the second axis 8 (the three-dot chain line in FIG. 11).

On the other hand, when roll-forming the bevel pinion 2, of the two gear dies 11, 11', a fourth axis 38 of the upper gear die 11' deviates from the second axis 8. As the roll-forming proceeds, the fourth axis 38 rotates in the circumferential direction of the second axis 8 (the three-dot chain line in FIG. 11).

In one embodiment, a gear roll-forming apparatus enables roll-forming of a bevel gear capable of meshing with a bevel pinion, including: a pinion die that is substantially the same in configuration and size as the bevel pinion; a pinion die holder for supporting the pinion die so as to allow rotation of the pinion die about a first axis of the pinion die while preventing movement of the pinion die in an axial direction of the pinion die from a small-diameter side toward a large-diameter side thereof; a gear die that is substantially the same in configuration and size as the bevel gear and meshes with the pinion die; and a pressing member for bringing a bevel gear blank into press contact with the pinion die, the bevel gear blank being arranged so as to sandwich the pinion die in cooperation with the gear die, in which the gear die and the pinion die holder are relatively rotated about a second axis of the gear die, causing teeth of the pinion die to roll with respect to the bevel gear blank.

Here, as described above, the pinion die is supported on the pinion die holder. When, during the roll-forming of the bevel gear, the pinion die is brought into press contact with the bevel gear blank by the pressing member, a press-contact force is applied to the pinion die as the reaction force from the bevel gear blank. At this time, the bevel gear blank sandwiches the pinion die in cooperation with the gear die. Accordingly, at least part of the press-contact force applied to the pinion die from the bevel gear blank is borne by the gear die. A large bending moment due to the above-mentioned press contact force is thus prevented from acting on the pinion die. That is, the occurrence of bending stress in the pinion die is suppressed.

The pinion die is thus allowed to retain sufficient rigidity, whereby the teeth corresponding to the profile of the teeth of the pinion die are roll-formed in the bevel gear blank with greater accuracy. That is, the dimensional accuracy of the bevel gear thus roll-formed is improved in a more satisfactory manner.

Here, as described above, when the pinion die, and the gear die and the bevel gear blank are brought into press contact with each other by the pressing member as described above, the axial component force applied to the pinion die causes the pinion die to make involuntary movement from the small-diameter side toward the large-diameter side thereof.

However, as described above, the pinion die holder prevents such movement of the pinion die from the small-diameter side toward the large-diameter side in the axial direction thereof.

Accordingly, the teeth corresponding to the profile of the teeth of the pinion die are roll-formed in the bevel gear blank with greater accuracy. That is, a further improvement is achieved in terms of the dimensional accuracy of the bevel gear thus roll-formed.

Further, as described above, the press-contact forces applied from the gear die and the bevel gear blank to the pinion die are opposed to each other, thus preventing bending stress from being exerted on the pinion die. Accordingly, the pinion die and the pinion die holder supporting the pinion die can be set to have low rigidity or strength. This allows a corresponding reduction in the size and cost of the gear roll-forming apparatus.

In one embodiment, a plurality of the pinion dies are provided in a circumferential direction of the second axis of the gear die and arranged at substantially equal intervals.

Accordingly, when, as described above, the bevel gear blank is brought into press contact with each of the pinion dies by the pressing member, the reaction forces applied from the respective pinion dies to the bevel gear blank in opposition to the press contact become uniform. The roll-forming of the bevel gear blank by the respective pinion dies thus proceeds in a uniform manner, and the bevel gear blank is accurately moved in parallel toward each of the pinion dies in the axial direction of the second axis.

Therefore, the teeth corresponding to the profile of the teeth of each pinion die are roll-formed in the bevel gear blank with greater accuracy. That is, a further improvement is achieved in terms of the dimensional accuracy of the bevel gear thus roll-formed.

In another embodiment, relative rotation between the pinion die holder and the gear die, one of the pinion die holder and the gear die is made stationary and the other is rotated forward and reverse.

Accordingly, as described above, when roll-forming the bevel gear by the pinion die, during the relative rotation between the pinion die holder and the gear die, one of the pinion die holder and gear die is held stationary while the other is rotated in one direction and then rotated in the direction reverse to that direction, thus allowing such forward/reverse rotation to be repeated. This makes it possible to eliminate an unbalance in the gear roll-forming apparatus occurring based on the elastic deformation in every part of the gear roll-forming apparatus when rotation takes place in only one direction. Therefore, the sectional configuration of the tooth profile of the bevel gear thus roll-formed can be made laterally uniform with greater accuracy. That is, a further improvement is achieved in terms of the dimensional accuracy of the bevel gear thus roll-formed.

In another embodiment, a gear roll-forming apparatus which enables roll-forming of a bevel pinion capable of meshing with a bevel gear includes a pair of gear dies that are substantially the same in configuration and size as the bevel gear and arranged so that their respective teeth are opposed to each other; a pinion blank holder for supporting a bevel pinion blank so as to allow rotation of the bevel pinion blank about a first axis of the bevel pinion blank while preventing movement of the bevel pinion blank in an axial direction of the bevel pinion blank from a small-diameter side toward a large-diameter side thereof; and a pressing member for bringing each of the gear dies into press contact with the bevel pinion blank that is sandwiched between the gear dies, in which at least one of the gear dies and the pinion blank holder are relatively rotated about a second axis of the gear die, causing teeth of the gear die to roll with respect to the bevel pinion blank.

Here, as described above, the bevel pinion blank is supported on the pinion blank holder. When, during the roll-forming of the bevel pinion, the gear dies are brought into press contact with the bevel pinion blank by the pressing member, press-contact forces are applied to the bevel pinion blank from the respective gear dies. However, since the bevel pinion blank is sandwiched between the two gear dies, the press-contact forces applied to the bevel pinion blank from the respective gear dies are opposed to each other, thereby preventing a large bending moment from acting on the bevel pinion blank. That is, the occurrence of bending stress in the bevel pinion blank is suppressed.

The bevel pinion blank is thus allowed to retain sufficient rigidity, whereby teeth corresponding to the profile of the teeth of the gear dies are roll-formed in the bevel pinion blank with greater accuracy. That is, the dimensional accuracy of the bevel pinion thus roll-formed is improved in a more satisfactory manner.

Here, as described above, when each of the gear dies and the bevel pinion blank are brought into press contact with each other by the pressing member as described above, the axial component force applied to the bevel pinion blank causes the bevel pinion blank to make involuntary movement from the small-diameter side toward the large-diameter side thereof.

However, as described above, the pinion blank holder prevents such movement of the bevel pinion blank from the small-diameter side toward the large-diameter side in the axial direction thereof.

Accordingly, the teeth corresponding to the profile of the teeth of the gear dies are roll-formed in the bevel pinion blank with greater accuracy. That is, a further improvement is achieved in terms of the dimensional accuracy of the bevel pinion thus roll-formed.

Further, the gear dies used are not rack-type flat dies used in the conventional art but are those corresponding to the tooth profile of the bevel gear that can mesh with the bevel pinion. This allows a further improvement in the dimensional accuracy of the bevel pinion roll-formed by the respective gear dies.

In another embodiment, a plurality of the bevel pinion blanks are provided in a circumferential direction of the second axis of the gear die and arranged at substantially equal intervals.

Accordingly, when, as described above, the respective gear dies are brought into press contact with the bevel pinion blanks by the pressing member, the resulting pressing forces are applied to the respective bevel pinion blanks in a uniform manner. The roll-forming of the respective bevel pinion blanks by the gear dies thus proceeds in a uniform manner, and the gear dies are accurately moved in parallel toward the bevel pinion blank in the axial direction of the second axis.

Therefore, the teeth corresponding to the profile of the teeth of the respective gear dies are roll-formed in the bevel pinion blanks with greater accuracy. That is, a further improvement is achieved in terms of the dimensional accuracy of the bevel pinion thus roll-formed.

Further, according to the above-described construction, a plurality of bevel pinions can be roll-formed at the same time, thereby facilitating mass production of the bevel pinions.

In another embodiment, the pinion die is adapted to reciprocate in an axial direction thereof.

Accordingly, when, during the roll-forming of the bevel gear, the pinion die is reciprocated as described above and this reciprocating movement is repeated, crowning can be applied on the tooth profile of the roll-formed bevel gear. Therefore, when, for example, a bevel gear is assembled onto the case through a bearing in the power transmission system of a vehicle or the like, even when there is a deficiency of the clearance of the bearing or deficiency of the case, the roll-forming of the bevel gear can be readily performed that is favorable in terms of noise prevention at the time of meshing engagement or durability.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A gear roll-forming apparatus for roll-forming of a bevel gear capable of meshing with a bevel pinion, comprising:

a pinion die that is substantially the same in configuration and size as the bevel pinion;

a pinion die holder configured to support the pinion die so and to allow rotation of the pinion die about a first axis of the pinion die while substantially preventing movement of the pinion die in an axial direction of the pinion die from a small-diameter side toward a large-diameter side thereof;

a gear die that is substantially the same in configuration and size as the bevel gear and meshes with the pinion die; and a press member configured to bring a bevel gear blank into press contact with the pinion die, the bevel gear blank configured to sandwich the pinion die in cooperation with the gear die and comprising a boss portion located on a second axis whose lower portion can be fitted into a mating hole formed in the gear die, wherein the gear die and the pinion die holder are relatively rotated about the second axis of the gear die, causing teeth of the pinion die to roll with respect to the bevel gear blank.

2. The gear roll-forming apparatus according to claim 1, wherein a plurality of the pinion dies are provided in a circumferential direction of the second axis of the gear die.

3. The gear roll-forming apparatus according to claim 2, wherein the plurality of pinion dies are arranged at substantially equal intervals.

4. The gear roll-forming apparatus according to claim 3, wherein there are three pinion dies.

5. A gear roll-forming apparatus for roll-forming of a bevel gear capable of meshing with a bevel pinion, comprising:

a pinion die that is substantially the same in configuration and size as the bevel pinion;

a pinion die holder configured to support the pinion die so and to allow rotation of the pinion die about a first axis of the pinion die while substantially preventing movement of the pinion die in an axial direction of the pinion die from a small-diameter side toward a large-diameter side thereof;

a gear die that is substantially the same in configuration and size as the bevel gear and meshes with the pinion die;

a press member configured to bring a bevel gear blank into press contact with the pinion die, the bevel gear blank configured to sandwich the pinion die in cooperation with the gear die;

wherein the gear die and the pinion die holder are relatively rotated about a second axis of the gear die, causing teeth of the pinion die to roll with respect to the bevel gear blank; and wherein during relative rotation between the pinion die holder and the gear die, one of the pinion die holder and the gear die is made stationary and the other is rotated forward and reverse.

6. A gear roll-forming apparatus for roll-forming of a bevel gear capable of meshing with a bevel pinion, comprising:

a pinion die that is substantially the same in configuration and size as the bevel pinion;

a pinion die holder configured to support the pinion die so and to allow rotation of the pinion die about a first axis of the pinion die while substantially preventing movement of the pinion die in an axial direction of the pinion die from a small-diameter side toward a large-diameter side thereof;

a gear die that is substantially the same in configuration and size as the bevel gear and meshes with the pinion die;

a press member configured to bring a bevel gear blank into press contact with the pinion die, the bevel gear blank configured to sandwich the pinion die in cooperation with the gear die;

wherein the gear die and the pinion die holder are relatively rotated about a second axis of the gear die, causing teeth of the pinion die to roll with respect to the bevel gear blank; and wherein the pinion die is configured to reciprocate in an axial direction thereof.

7. A gear roll-forming apparatus which enables roll-forming of a bevel pinion capable of meshing with a bevel gear, comprising:

a pair of gear dies that are substantially the same in configuration and size as the bevel gear and arranged so that their respective teeth are opposed to each other;

a pinion blank holder configured to support a bevel pinion blank so as to allow rotation of the bevel pinion blank about a first axis of the bevel pinion blank while preventing movement of the bevel pinion blank in an axial direction of the bevel pinion blank from a small-diameter side toward a large-diameter side thereof;

at least one guide protruding from a base, the guide configured to permit the pinion blank holder to move only in the axial direction of a second axis; and a press member configured to bring each of the gear dies into press contact with the bevel pinion blank that is sandwiched between the gear dies, wherein at least one of the gear dies and the pinion blank holder are relatively rotated about the second axis of the gear die, causing teeth of the gear die to roll with respect to the bevel pinion blank.

8. The gear roll-forming apparatus according to claim 7, wherein a plurality of the bevel pinion blanks are provided in a circumferential direction of the second axis of the gear die.

9. The gear roll-forming apparatus according to claim 8, wherein the bevel pinion blanks are arranged at substantially equal intervals.

10. The gear roll-forming apparatus according to claim 9, wherein there are three bevel pinion blanks.

* * * * *